US011486104B2

(12) United States Patent
Martinez et al.

(10) Patent No.: US 11,486,104 B2
(45) Date of Patent: Nov. 1, 2022

(54) VEHICLE RESTRAINT DEVICE PACKAGE HAVING SPIKES

(71) Applicant: MADMEX LLC., Prescott, AZ (US)

(72) Inventors: Martin Martinez, Prescott, AZ (US); Steven Floyd, Petaluma, CA (US)

(73) Assignee: MADMEX, LLC, Prescott, AZ (US)

( * ) Notice: Subject to any disclaimer, the term of this patent is extended or adjusted under 35 U.S.C. 154(b) by 65 days.

(21) Appl. No.: 16/983,589

(22) Filed: Aug. 3, 2020

(65) Prior Publication Data

US 2021/0047792 A1 Feb. 18, 2021

Related U.S. Application Data

(60) Provisional application No. 62/922,542, filed on Aug. 15, 2019.

(51) Int. Cl.
*E01F 13/12* (2006.01)

(52) U.S. Cl.
CPC ..... *E01F 13/12* (2013.01)

(58) Field of Classification Search
None
See application file for complete search history.

(56) References Cited

U.S. PATENT DOCUMENTS 3,456,920 A * 7/1969 Elvington ..... E01F 13/12 404/6
5,123,774 A * 6/1992 Dubiel ..... E01F 13/12 404/6
5,330,285 A * 7/1994 Greves ..... E01F 13/12 404/6
5,452,962 A * 9/1995 Greves ..... E01F 13/12 404/6
5,775,832 A * 7/1998 Kilgrow ..... E01F 13/12 404/6
5,820,293 A * 10/1998 Groen ..... E01F 13/12 404/6
7,435,033 B1 * 10/2008 Esbenshade ..... E01F 13/123 404/6
8,132,980 B1 * 3/2012 Lee ..... E01F 13/12 404/6
8,858,113 B1 * 10/2014 Bettendorf ..... E01F 13/12 404/6
9,896,314 B2 * 2/2018 Zelinsky ..... E01F 13/12
10,370,807 B2 * 8/2019 Stevens ..... E01F 13/12
10,408,557 B2 * 9/2019 Verdino ..... F41H 11/10
2014/0199118 A1 * 7/2014 Wersching ..... E01F 13/12 404/6
2017/0183204 A1 * 6/2017 Zelinsky ..... E01F 13/12
2021/0010215 A1 * 1/2021 Creaven ..... F41H 11/10

FOREIGN PATENT DOCUMENTS

FR 3054569 A1 * 2/2018

* cited by examiner

*Primary Examiner* — Gary S Hartmann

(74) *Attorney, Agent, or Firm* — Weiss & Moy, P.C.; Jeffrey D. Moy

(57) ABSTRACT

A vehicle restraint device has an outer housing. An inner housing is positioned within the outer housing. A plurality of spikes is removably attached to the inner housing.

15 Claims, 7 Drawing Sheets

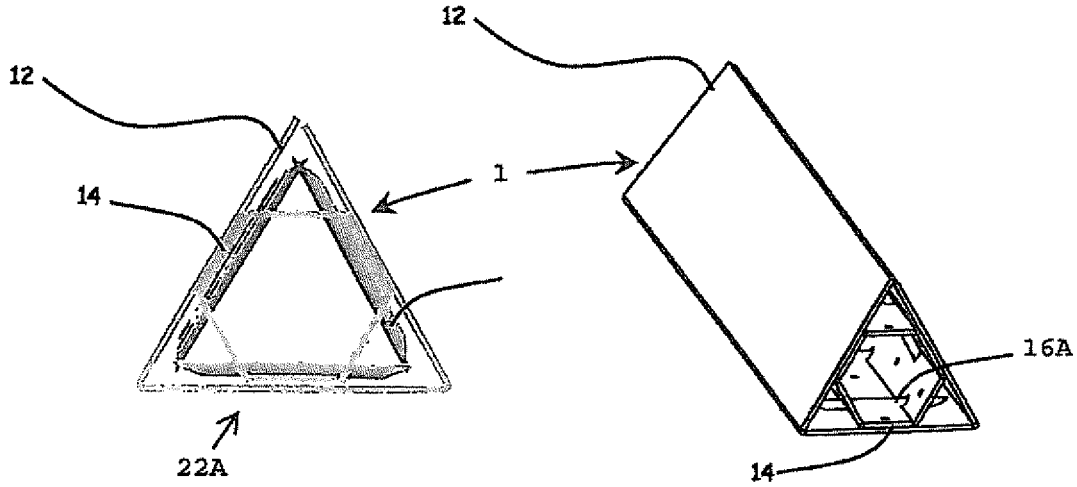
Fig. 3b
Fig. 3a
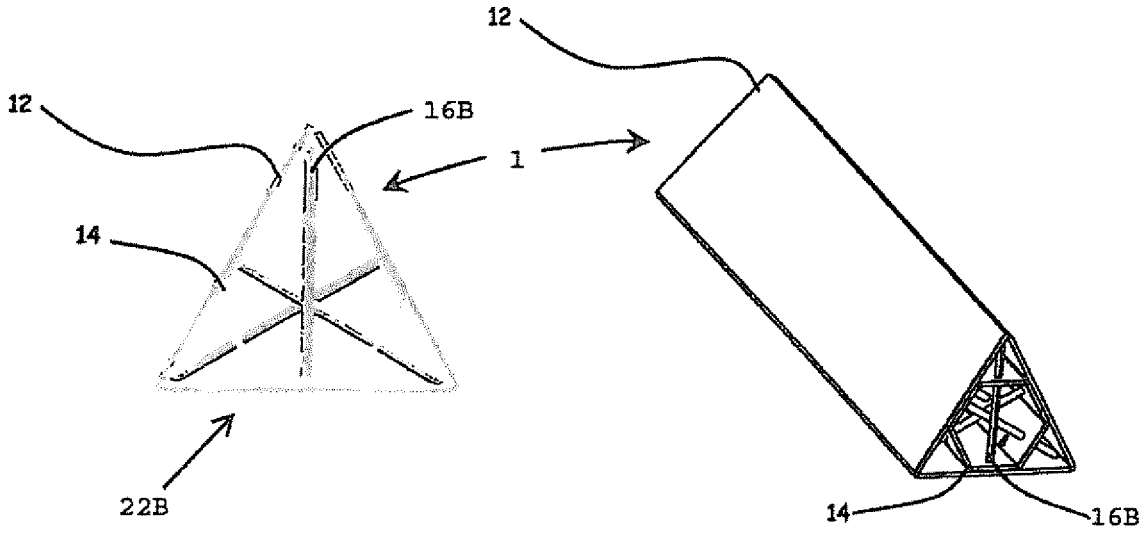
Fig. 3d
Fig. 3c

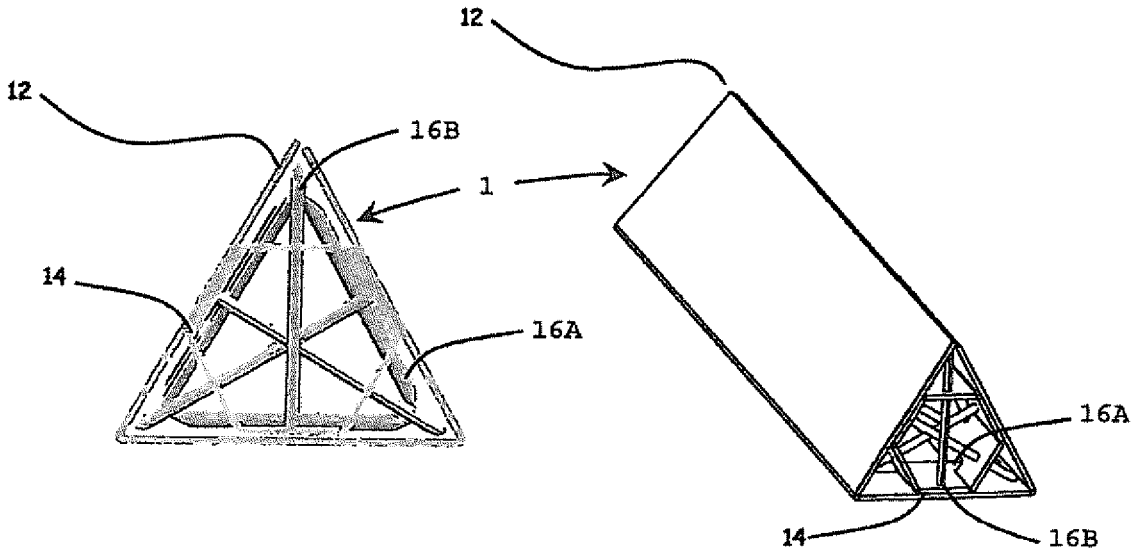
Fig. 3f
Fig. 3e
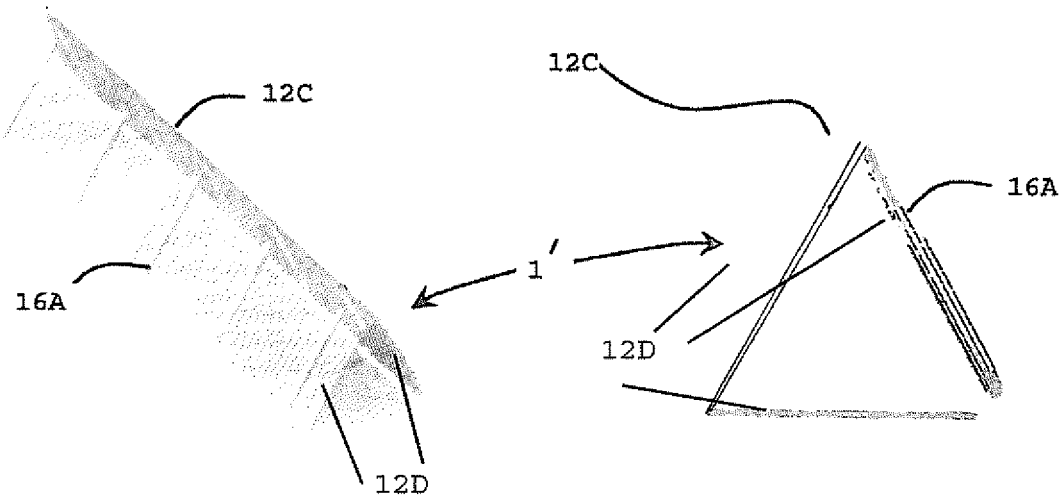
Fig. 4a
Fig. 4b

VEHICLE RESTRAINT DEVICE PACKAGE HAVING SPIKES

RELATED APPLICATIONS

The present patent application is related to related to U.S. Provisional Application Ser. No. 62/922,542, filed Aug. 15, 2019, in the name of the same inventor, and entitled. "VEHICLE RESTRAINT DEVICE PACKAGE", the present patent application claims the benefit under 35 U.S.C. § 119(e).

TECHNICAL FIELD

The present application relates generally to a vehicle restraint device, and more specifically, to a device that incorporates a container that is thrown, propelled, or placed on a surface, the container includes a set of spikes that project upwardly, the spikes having the ability to penetrate a tire of a vehicle and allow the egress of air from the tire.

BACKGROUND

Devices for stopping a fleeing vehicle are presently available. These devices include, but not limited to, barriers, tire spike strips, caltrops, snares and electrical system disabling devices. The most commonly known of these devices is the spike strip. Spike strips are devices having spikes projecting upwardly from a base structure, usually an elongated structure, either a rolled-up device, a series of sticks or strips or an accordion type device. The spike strip may be placed on a road in anticipation that a fleeing target vehicle will be driven over the spike strip. Once the tire of the fleeing vehicle makes contact with the spike strip, the spikes will cause deflation of vehicle tires, and eventually cause the vehicle to stop due to the vehicle being difficult to control with flat tires.

Spike strips are generally deployed by first response personnel, law enforcement personnel and other security personnel. The deployment of the spike strip often places these security personnel in danger. The cur-rent method of deploying a spike strip requires the security personnel to toss the spike strip across a target vehicle's path. The driver of the fleeing car may try to run down the security personnel deploying the spike strip or try to avoid the spike strip veering off the road and hit security personnel or other bystanders, Other methods of deployment include remote placement or placement in front of a stopped vehicle to prevent it from driving away.

Current spike strip designs generally consist of spikes include in a thin extruded outer sleeve, foam, and reinforced strapping tape. The spikes may be encased in the foam. The tape may be applied to the surfaces of the foam to ensure the spikes are secured and do not fall out of the foam. The taped foam and spike sub-assembly may be assembled/slid into the outer sleeve. Unfortunately, current spike strip designs are not reusable as the outer sleeve and foam are crushed when the spike strip is engaged by the tire of a fleeing vehicle.

Therefore, it would be desirable to provide a spike strip device and method that overcomes the above.

SUMMARY

In accordance with one embodiment, a vehicle restraint device is disclosed. The vehicle restraint device has an outer housing. An inner housing is positioned within the outer housing. A plurality of spikes is removably attached to the inner housing.

In accordance with one embodiment, a vehicle restraint device is disclosed. The vehicle restraint device has an outer triangular tubular housing. An inner hexagonal tubular housing is positioned within the outer triangular tubular housing. A plurality of perforations is formed through the inner hexagonal tubular housing. A plurality of spikes is removably attached to the inner housing, the perforations removably holding the plurality of spikes within the inner hexagonal tubular housing.

In accordance with one embodiment, a vehicle restraint device is disclosed. The vehicle restraint device has an outer triangular tubular housing, An inner hexagonal tubular housing is positioned within the outer triangular tubular housing. A plurality of perforations is formed through the inner hexagonal tubular housing. A plurality of spikes is removably attached to the inner housing, the perforations removably holding the plurality of spikes within the inner hexagonal tubular housing. Each spike has a hollow cylindrical member. A pointed end is formed on at least one end of the cylindrical member.

In accordance with one embodiment, a vehicle restraint device is disclosed. The vehicle restraint device has a tubular housing. A plurality of spikes is positioned along a length of the tubular housing, wherein each spike is positioned within a corrugation formed within a plurality of walls forming the tubular housing.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

FIG. 3*a* is a perspective view of an exemplary vehicle restraint device with the spike pattern shown in FIG. 2*a*2*b* in accordance with one aspect of the present application;

FIG. 3*b* is a cross-sectional view of an exemplary vehicle restraint device FIG. 3*a* with the spike pattern shown in FIG. 2*a*-2*b* in accordance with one aspect of the present application;

FIG. 3*c* is a perspective view of an exemplary vehicle restraint device with the spike pattern shown in FIG. 2*c*-2*d* in accordance with one aspect of the present application;

FIG. 3*d* is a cross-sectional view of an exemplary vehicle restraint device shown in FIG. 3*c* with the spike pattern shown in FIG. 2*c*-2*d* in accordance with one aspect of the present application;

FIG. 3*e* is a perspective view of an exemplary vehicle restraint device with the spike pattern shown in FIG. 2*e*-2*f* in accordance with one aspect of the present application;

FIG. 3*f* is a cross-sectional view of an exemplary vehicle restraint device shown in FIG. 3*e* with the spike pattern shown in FIG. 2*e*-2*f* in accordance with one aspect of the present application;

DESCRIPTION OF THE APPLICATION

Figure 1A:
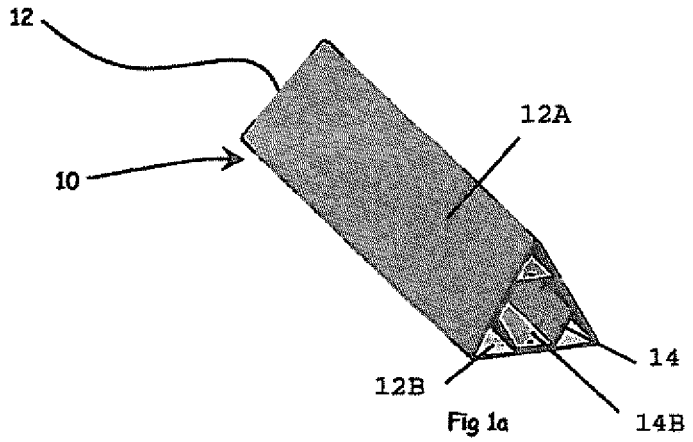
FIG. 1*a* is an elevated perspective view of, an exemplary housing of a vehicle restraint device in accordance with one aspect of the present application.
Figure 1B:
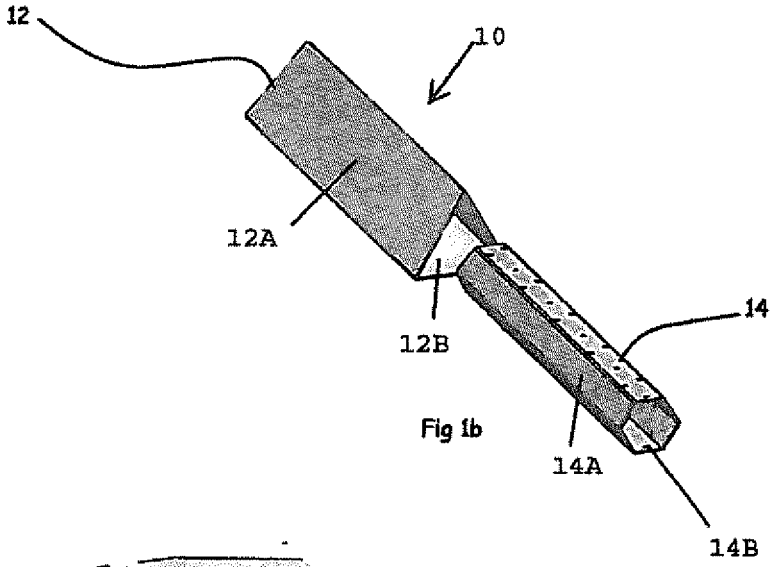
FIG. 1*b* is an exploded perspective view of an exemplary housing of the vehicle restraint device of FIG. 1*a* in accordance with one aspect of the present application.
Figure 1C:
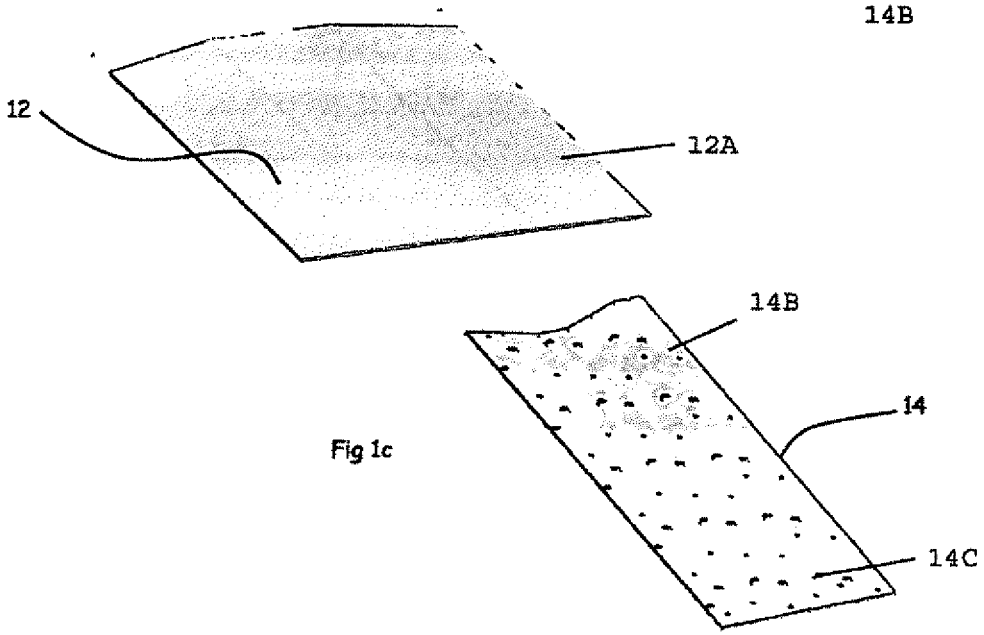
FIG. 1*c* is an unfolded perspective view of an exemplary, housing of the vehicle restraint device of FIG. 1*a* in accordance with one aspect of the present application.
Figure 1D:
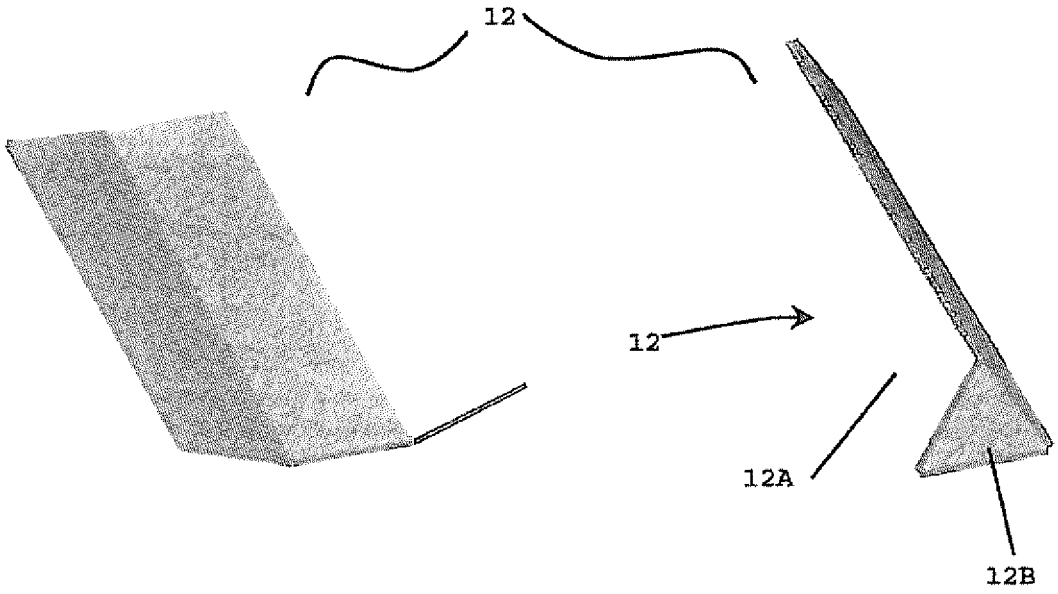
FIG. 1*d* is a perspective view of an exemplary an outer housing of the vehicle restraint device of FIG. 1*a* in an unfolded and folded position in accordance with one aspect of the present application.

The present description incorporates the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within, the spirit and scope of this disclosure.

Embodiments of the vehicle restraint device, system, and method (hereinafter device) utilizes the geometric relationship between different geometric shapes forming an inner and outer housing. In accordance with one embodiment, hexagonal and triangular shapes may be used to form the inner and outer housings. The device may capitalize on the corrugations present in corrugated cardboard and plastic sheet construction.

Referring to FIGS. 1*a*-1*d*, one exemplary embodiment of a housing 10 (hereinafter housing 10) for a vehicle restraint device 1 (hereinafter device 1) may be described. The housing 10 may be, designed to hold a plurality of spikes which may be used to deflate the tires of a vehicle. The housing 10 may be formed of an outer housing 12 having exterior surfaces 12A and interior surfaces 12B and an inner housing 14 having exterior surfaces 14A and interior surfaces 14B. The device 1 utilizes the geometric relationship between different geometric shapes forming the inner housing 14 and the outer housing 12. The outer housing 12 and the inner housing 14 may be formed by folding pre-cut geometric shapes of light weight and sturdy material. For example, the outer housing 12 and the inner housing 14 may be formed of materials such as, but not limited to, fiberglass, composite material, plastic, cardboard, corrugated plastic or any other similar material.

In the embodiment shown, the outer housing 12 may be a triangular tube and the inner housing 14 may be a hexagonal tube. The device 1 may be designed so that the inner housing 14 slides within an interior of the outer housing 12 such that the exterior surfaces 14A of the inner housing 14 engage with the interior surfaces 12B of the outer housing 12.

The inner housing 14 may be designed with a plurality of openings/perforations 14C formed through therethrough. The perforations 14C may be used to accommodate spikes 16 allowing the spikes 16 to extends through the inner housing 14.

Referring to FIGS. 2*a*-2*f* and 5*a*-5*b*, the device 1 may use spikes 16, Different spikes structures 16A and 16B (hereinafter spike 16A and 16B) may be used based on the configuration and application. It should be noted that the device 1 may use other types of spikes than those shown. Slotted spikes and other types of tubular spikes may be used without departing from the spirit and scope of the present invention. Spike 16A may be a cylindrical member 26 have sharp pointed ends 28 located at opposing ends of the cylindrical member 26. Spike 16B may be cylindrical member 26 have a sharp point end 28 located at one end and a flat end 30 located at the opposing end. In accordance with one embodiment, the cylindrical member 26 may be hollow.

As may be seen in FIGS. 2*a*-2*f*, the spikes 16A and 16B may be arranged and secured within the inner housing 14 in different spike patterns. The spikes 16A and/or 16B may be arranged and secured within the inner housing 14 so that one or both of the ends of the spikes 16A and/or 16B extend out of the inner housing 14. The spikes 16A and/or 16B may be designed to penetrate a tire, be pulled from the device 1 and allow air in the tire to exhaust through the hollow cylindrical member 26.

Figure 2B:
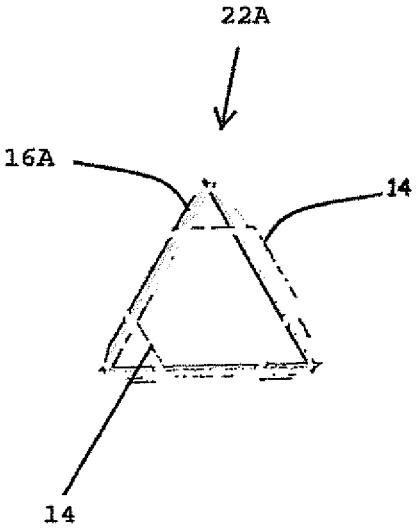
FIG. 2*b* is a cross-sectional view of the spike pattern contained and oriented in an inner tube of FIG. 2*a* prior to insertion into the outer housing in accordance with one aspect of the present application.
Figure 2A:
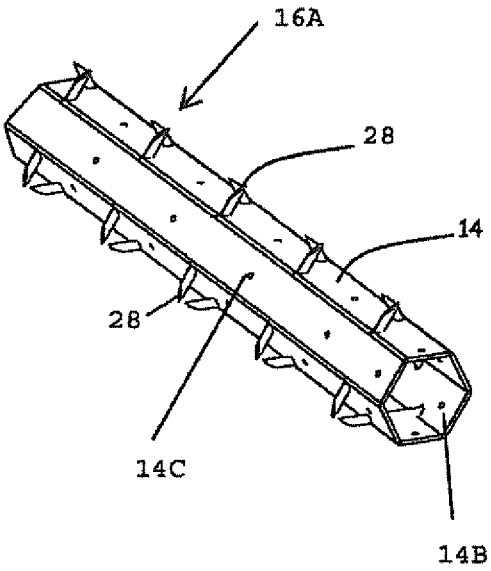
FIG. 2*a* is, a perspective view of a spike pattern contained and oriented in an, inner tube prior to insertion into the outer housing in accordance with one aspect of the present application.

In FIGS. 2*a*-2*b*, the spikes 16A may be positioned within the inner housing 14 in a triangular spike structure 22A. In the present embodiment, both sharp, point ends 28 of the spike 16A may be exposed and extend out from the inner housing 14, The spikes 16A may be arranged so that a first spike 16A may be positioned horizontally along a bottom interior surface of the inner housing 14. A pair of spikes 16A may be positioned on interior inward angles surfaces of the inner housing 14 thereby forming the triangular spike structure 22A. The inner housing 14 may secure multiple-triangular spike structures 22A running along a length of the inner housing 14.

Figure 2D:
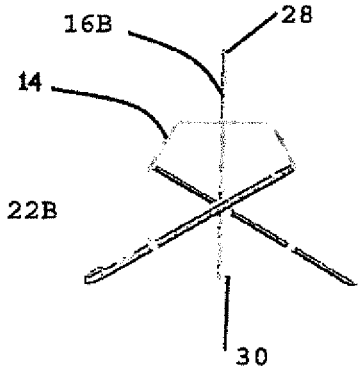
FIG. 2*d* is a cross-sectional view of the spike pattern contained and oriented in an inner tube of FIG. 2*c* prior to insertion into the outer housing in accordance with one aspect of the present application.
Figure 2C:
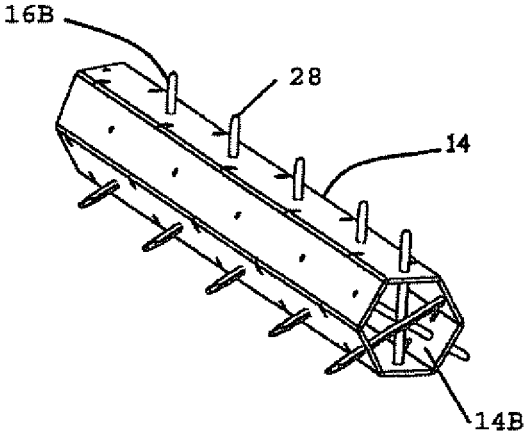
FIG. 2*e* is a perspective view of a spike pattern contained and oriented in an inner tube prior to insertion into the outer housing in accordance with one aspect of the present application.
FIG. 2*f* is a cross-sectional view of the spike pattern contained and oriented in an inner tube of FIG. 2*c* prior to insertion into the outer housing in accordance with one aspect of the present application.

Referring to FIG. 2*c*-2*d*, the spikes 16B may be positioned within the inner housing 14 so, that sharp point ends 28 of the spike 16B extend out of the inner housing 14 in a "Y" spike structure 22B. In the present embodiment, the spikes 16B may be positioned within the inner housing 14 so that flat end 38 of the spike 16B is positioned on the interior surfaces of the inner housing 14 while the sharp point end 28 of the spike 16B extend out of the inner housing 14 to form the "Y" spike structure 22B. The inner housing 14 may secure multiple triangular spike structures 22A running along the length of the inner housing 14.

Figure 2F:
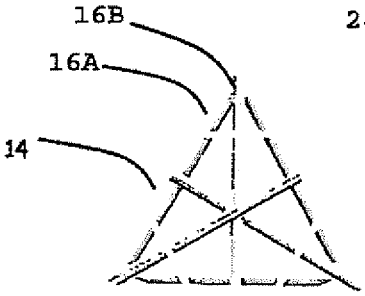
Figure 2E:
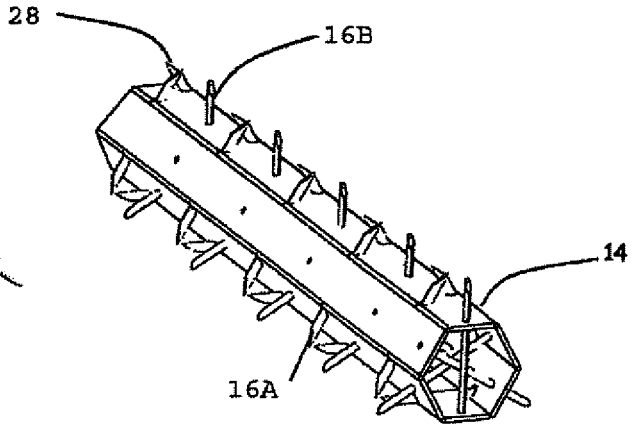

In FIGS. 2*e*-2*f*, the spikes 16A may be positioned within the inner housing 14 in a triangular spike structure 22A, while the spikes 16B may be positioned within the inner housing 14 so that sharp point ends 28 of the spike 16B extend out of the inner housing 14 in a "Y" spike structure 22B. In the present embodiment, the inner housing 14 may alternate between the triangular spike structure 22A and the Y" spike structure 22B along the length of the inner housing 14.

Referring to FIG. 3*a*-3*b*, the inner housing 14 may have the spikes 16A positioned in the triangular spike structure 22A along the length of the inner housing 14. The inner housing 14 may then be slid into the interior of the outer housing 12 to form the device 1.

Referring to FIG. 3*e*-3*d*, the inner housing 14 may have the spikes 16B positioned in a Y" spike structure 22B along the length of the inner housing 14. The inner housing 14 may then be slid into the interior of the outer housing 12 to form the device 1.

Referring to FIG. 3*e*-31, the inner housing 14 may have the spikes 16A positioned in the triangular spike structure 22A and the spikes 16B positioned in a Y" spike structure 22B alternating along the length of the inner housing 14. The inner housing 14 may then be slid into the interior of the outer housing 12 to form the device 1.

Referring to FIG. 4*a*-4*b*, another embodiment of the device 1' may be se in this embodiment, the device 1' may be formed of the outer housing 12. Spikes 16A and/or 16B may be positioned within corrugations 12C formed within the walls 121D forming the outer housing 12.

Figure 4C:
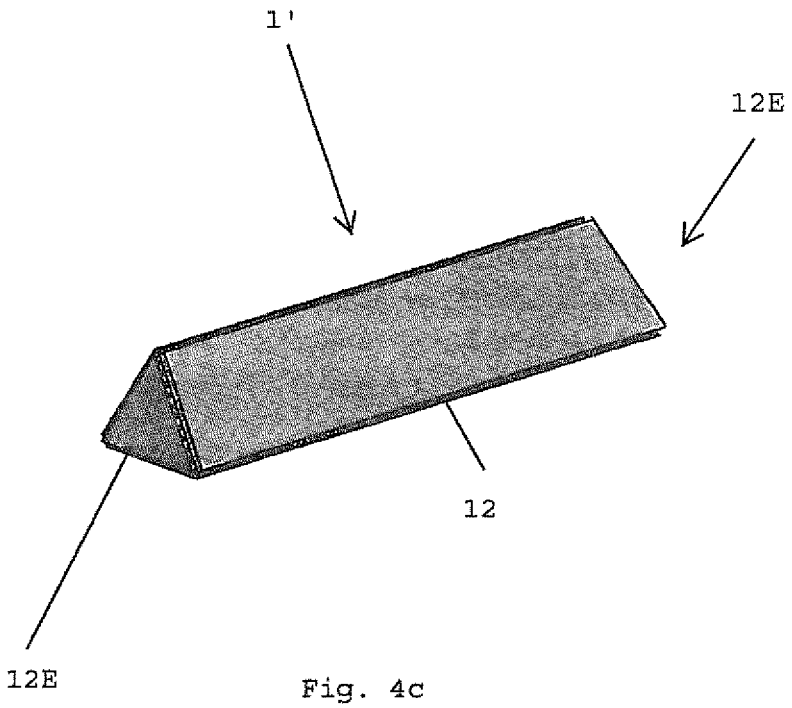
FIG. 4*a* is a perspective view of an exemplary vehicle restraint device with a spike pattern contained and oriented within the outer housing in accordance with one aspect of the present application.
FIG. 4*b* is a cross-sectional view of the exemplary vehicle restraint device shown in FIG. 4*a* in accordance with one aspect of the present application.
FIG. 4*e* is a perspective view of an exemplary vehicle restraint device with a spike pattern contained and oriented within the outer housing in accordance with one aspect of the present application.
Figure 5B:
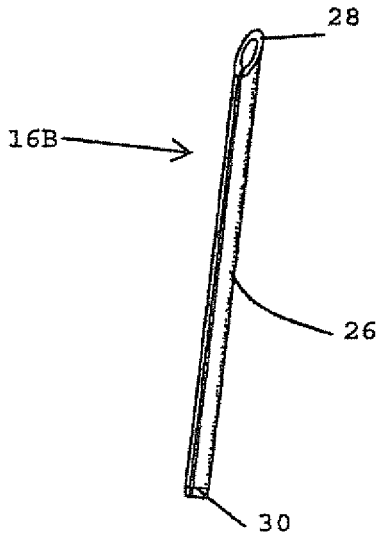
FIG. 5*b* is a perspective view of an exemplary spike used in the vehicle restraint device in accordance with one aspect of the present application.
Figure 5A:
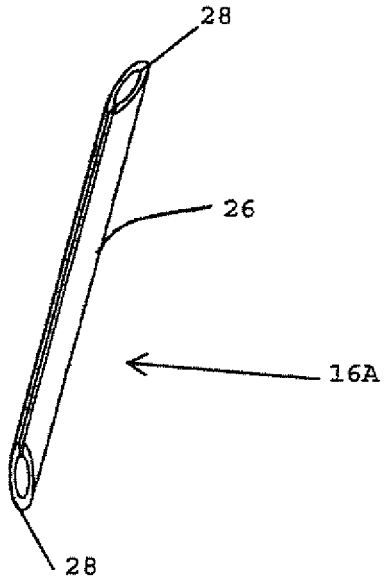
FIG. 5*a* is a perspective view of an exemplary spike used in the vehicle restraint device in accordance with one aspect of the present application.

Referring to FIG. 4*c*, the device 1' may be seen. In this embodiment, the device 1' may be formed of the outer housing 12 having an end cap 12E. While only one end cap 12E is shown, the end cap 12E may be formed on each end of the outer housing 12. Spikes 16A and/or 16B may be positioned within corrugations 12C formed within the walls 121 forming the outer housing 1 in the same manner as disclosed above. While the end cap 12E is shown on device it may be used on device 1 as well.

The operation of the device 1 or 1' (hereinafter device 1) may proceed as follows. The device 1 may be placed in an expected path of a vehicle. The placement of the device 1 may be such that the device 1 is deployed across a road surface. The device 1 may be remotely or manually placed on the road. Multiple devices 1, may be attached together to cover the road. In a remote manner, a remote-controlled device, such as a radio control vehicle or similar device, may be used to place the device 1 across the road. This may help to protect the security personnel deploying the device 1 by keeping them further away from the driver of the fleeing vehicle.

The inner housing 14 may hold various spike arrays and orientations that are desirable in that they may puncture the tires of a vehicle. When the vehicle runs over the device 1, the spikes 16A and/or 16B may penetrate and be pulled out of the inner housing 14 by the tires of the vehicle. The spikes 16A and/or 16B may puncture the tire of the vehicle. Since the spikes 16A and/or 16B may be formed of a hollow cylindrical member 26, the hollow cylindrical member 26 may allow air in the tire to escape more rapidly.

The device 1 provides an apparatus for restraining targeted land vehicles. The device 1 may capitalize on the geometric relationship between the inner housing 14 (i.e., hexagonal in shape) and the outer housing 12 (triangular in shape) to form a housing of the device. The inner housing 14 may supports and orients the spikes 16A and/or 16B as well as serve as a passage to a connection mechanism so that multiple devices 1 may be connected together.

The geometric relationship between the inner housing 14 (i.e., hexagonal in shape) and the outer housing 12 may provide a device 1 that is small, compact, reloadable and reusable. The simple construction of the inner housing 12 and outer housing may allow the device 1 to be produced in an economical manner.

The device 1 eliminates the thin extruded outer sleeve, and foam that is used currently in spike strips which causes current spike strips not to be reusable. The device 1 is reusable. The inner housing 14 may be reloaded with spikes 16A and/or 16B after being, used.

The foregoing description is illustrative of particular embodiments of the application, but is not meant to be a limitation upon the practice thereof. The following claims, including all equivalents thereof, are intended to define the scope of the application.

What is claimed is:

1. A vehicle restraint device comprising:

an outer housing, wherein the outer housing is of a triangular tube;

an inner housing positioned within the outer housing, wherein the inner housing is a hexagonal tube that slides within the triangular tube so that exterior surfaces of the hexagonal tube engage interior surfaces of the triangular tube;

a plurality of perforations formed through the hexagonal tube; and a first plurality of spikes each extending through a corresponding pair of the plurality of perforations so that opposing ends of each of the first plurality of spikes extends out of the hexagonal tube.

2. The vehicle restraint device of claim 1, wherein the first plurality of spikes comprises:

a cylindrical member;

a pointed end formed on at least one end of the cylindrical member.

3. The vehicle restraint device of claim 2, wherein the first plurality of spikes comprise a pointed end formed on opposing ends of the cylindrical member.

4. The vehicle restraint device of claim 2, wherein the cylindrical member is hollow.

5. The vehicle restraint device of claim 1, wherein the first plurality of spikes are arranged in a plurality of triangular configurations, the triangular configurations positioned along a length of the inner housing.

6. The vehicle restraint device of claim 5, comprising a second plurality of spikes each extending through only one of the plurality of perforations, wherein the second plurality of spikes are arranged in a plurality of Y" shaped configurations, the "Y" shaped configurations positioned along a length of the inner housing.

7. A vehicle restraint device comprising:

an outer triangular tubular housing;

an inner hexagonal tubular housing positioned within the outer triangular tubular housing;

a plurality of perforations formed through the inner hexagonal tubular housing; and a first plurality of spikes removably attached to the inner housing, the perforations removably holding the first plurality of spikes within the inner hexagonal tubular housing, wherein each of the first plurality of spikes extend through a corresponding pair of the plurality of perforations so that opposing ends of each of the first plurality of spikes extends out of the hexagonal tube.

8. The vehicle restraint device of claim 7, wherein the first plurality of spikes comprise:

a cylindrical member;

a pointed end formed on at least one end of the cylindrical member.

9. The vehicle restraint device of claim 7, wherein the first plurality of spikes comprise a pointed end formed on opposing ends of the cylindrical member.

10. The vehicle restraint device of claim 7, wherein the cylindrical member is hollow.

11. The vehicle restraint device of claim 7, wherein the first plurality of spikes are arranged in a plurality of triangular configurations, the triangular configurations positioned along a length of the inner housing.

12. The vehicle restraint device of claim 11, comprising a second plurality of spikes each extending through one of the plurality of perforations, wherein the second plurality of spikes are arranged in a plurality of Y" shaped configurations, the "Y" shaped configurations positioned along a length of the inner housing.

13. A vehicle restraint device comprising:

an outer triangular tubular housing;

an inner hexagonal tubular housing positioned within the outer triangular tubular housing;

a plurality of perforations formed through the inner hexagonal tubular housing; and a plurality of spikes removably attached to the inner housing, the perforations removably holding the plurality of spikes within the inner hexagonal tubular housing, wherein each spike comprises:

a hollow cylindrical member; and a pointed end formed on at least one end of the cylindrical member;

wherein the plurality of spikes comprises a first plurality of spikes, wherein each of the first plurality of spikes extend through a corresponding pair of the plurality of perforations so that opposing ends of each of the first plurality of spikes extends out of the hexagonal tube, wherein each opposing end is pointed.

14. The vehicle restraint device of claim 13, wherein the first plurality of spikes are arranged in a plurality of triangular configurations, the triangular configurations positioned along a length of the inner housing.

15. The vehicle restraint device of claim 14, comprising a second plurality of spikes each extending through one of the plurality of perforations, wherein the second plurality of spikes are arranged in a plurality of "Y" shaped configurations, the "Y" shaped configurations positioned along a length of the inner housing.

* * * * *